US007380887B2

(12) United States Patent
Latham

(10) Patent No.: US 7,380,887 B2
(45) Date of Patent: Jun. 3, 2008

(54) TOOL HOLDER

(75) Inventor: Winchester E. Latham, Avon, IN (US)

(73) Assignee: Keystone Engineering & Manufacturing Corp., Avon, IN (US)

( * ) Notice: Subject to any disclaimer, the term of this patent is extended or adjusted under 35 U.S.C. 154(b) by 0 days.

(21) Appl. No.: 11/403,325

(22) Filed: Apr. 13, 2006

(65) Prior Publication Data

US 2007/0245253 A1 Oct. 18, 2007

(51) Int. Cl.
*E21C 35/18* (2006.01)

(52) U.S. Cl. ..... 299/87.1

(58) Field of Classification Search ..... 299/87.1, 299/102–113

See application file for complete search history.

(56) References Cited

U.S. PATENT DOCUMENTS 4,337,980 A * 7/1982 Krekeler ..... 299/102
4,480,873 A 11/1984 Latham
4,697,850 A 10/1987 Tuneblom
4,871,213 A 10/1989 Hanson
5,016,943 A 5/1991 Wirtgen
5,052,757 A 10/1991 Latham
5,078,540 A 1/1992 Jakob et al.
5,098,167 A 3/1992 Latham
5,186,575 A 2/1993 Wirtgen
5,303,458 A * 4/1994 Sheehan et al. ..... 29/405
5,536,073 A 7/1996 Sulosky et al.
5,582,468 A 12/1996 Latham
5,639,180 A 6/1997 Sulosky et al.
5,647,641 A 7/1997 Suloxky et al.
5,842,747 A 12/1998 Winchester
5,884,979 A 3/1999 Latham
6,331,035 B1 12/2001 Montgomery, Jr.
6,357,832 B1 3/2002 Sollami
6,382,733 B1 5/2002 Parrott
6,546,977 B1 4/2003 Monyak et al.
6,585,327 B2 7/2003 Sollami
6,644,755 B1 * 11/2003 Kammerer ..... 299/104
6,692,083 B2 2/2004 Latham
6,832,818 B2 12/2004 Luciano
2006/0119165 A1 * 6/2006 Holl et al. ..... 299/106

* cited by examiner

*Primary Examiner*—Sunil Singh
(74) *Attorney, Agent, or Firm*—Brinks Hofer Gilson & Lione

(57) ABSTRACT

A tool holder includes a body, a head, and a flange. The body is dimensioned to fit closely within a slot formed within a flight block. The head is positioned at a distal end of the body and has a recess to receive a cutting tool and hold the cutting tool in a rotationally forward orientation. The head includes a threaded bore extending from the recess to an outer surface, and a set screw positioned within the threaded bore, to selectively engage and secure a cutting tool therein. The flange is positioned adjacent the head and extends from the body in a rotationally forward direction. The flange is angled away from the cutting tool recess and to one side of the tool holder to facilitate deflection of debris away from the interface of the flight block and the tool holder and to one side of the tool holder.

18 Claims, 7 Drawing Sheets

TOOL HOLDER

BACKGROUND

1. Field of the Invention

The invention generally relates to rotary driven cylindrical cutters and scarifiers for use in earth-working, mining, or other in situ disintegration of hard materials. The invention is particularly directed to a tool holder for such a machine.

2. Background of the Invention

In general, roadway mining or planing equipment includes a rotary driven cylindrical comminuting drum which acts to scarify and to mine the top portion of the asphaltic road surface in situ. The rotary driven drum includes flighting on the drum which acts to collect and move the mined material toward the center of the drum where it can be removed. Often the mined material is then remixed with additional bituminous material and thereafter re-deposited as a newly formed smooth asphaltic surface. The rotary driven drums can also be used in other types of mining including subterranean extraction of desirable minerals and ores.

In some prior art devices of this type, the flighting is itself formed from a plurality of cutting bit support members which are connected to the curved surface of the cutting drum by bolts which pass from the upper surface of the flighting downward into the drum to engage threaded openings in the drum. Alternatively, the cutting bit support members can be welded to the drum or to the flighting.

A plurality of flight blocks can be arranged end-to-end so as to form a substantially continuous helical flighting. The top surface of the helical flighting is generally elevated above the curved surface of the drum. The flight blocks can include angled openings into which conventional tool holders are received. Each tool holder has a recess to receive a cutting tool.

In use, the tool holders may vibrate and otherwise move within the flight blocks. Particularly in the presence of abrasive debris from the roadway mining operation, the vibration and movement of the tool holders can act to enlarge the slot within the flight block receiving the tool holder to such an extent that the tool holder is no longer retained. Additionally, the presence of dust and debris that is being churned up by the cutting tool itself can get pushed into the flight block, between the wall of the slot and the tool holder. This debris causes added and accelerated wear on the tool holder and flight block.

When the tool holder is no longer held securely in the flight block, it then becomes necessary to remove the old flight block, usually with the aid of a cutting torch, and to weld a new flight block in its place. Again, this repair job is difficult to do in the field and still achieve accurate alignment of the flight block on the flighting section. Misalignment of the flight block results in undesirable lateral forces on a new cutting tool which in turn results in very fast wear and ultimate failure of the replaced parts.

The vibration induced wear can also occur between the tool holders and the cutting tool itself. Some rotational movement of the cutting tool may be desirable to permit the cutting tool to suffer even wear. Any rotational movement of the tool can cause wear of the part holding the tool, whether the tool holder or any intermediate sleeve. It is desirable to retain the cutting tool in the tool holder so long as the cutting surface of the cutting tool remains satisfactory to perform the desired cutting action. If a cutting tool experiences too much wear it may be ejected from or drop from the tool holder. If the tool holder experiences too much wear in surfaces confronting the cutting tool, the tool holder may not be able to retain even a new cutting tool, thus mandating the replacement of the tool holder. Thus, it is desirable to accommodate some measure of wear between the cutting tool and the tool holder while minimizing the wear on the tool holder itself.

Thus, there remains a need for a tool holder that can be used with standard flight blocks, and will resist the intrusion of debris between the tool holder and the cutting tool and will retain the cutting tool for a longer time. There remains a further need for a tool holder that can accommodate or compensate for some measure of wear of the cutting tool in relation to the tool holder.

SUMMARY

The present invention relates to a tool holder for a scarifying milling machine. In one aspect, the tool holder includes a body portion that is dimensioned to fit closely within a slot formed within a flight block. A head portion is positioned at a distal end of the body portion. The head portion includes a recess that is adapted to receive a cutting tool. The recess is oriented such that the cutting to is held in a rotationally forward orientation. A flange is positioned adjacent the head portion and extends from the body portion in a rotationally forward direction. The flange is adapted to deflect debris away from the interface of the flight block and the tool holder and to prevent debris from entering between the flight block and the tool holder.

In another aspect, the flange is angled away from the recess to facilitate the flow of debris away from the cutting tool.

In still another aspect, the flange is angled to one side of the body of the tool holder to facilitate the flow of debris away from the recess and to one side of the tool holder.

In yet another aspect, the tool holder includes a threaded bore extending from the recess to an outer surface of the head portion. A threaded set screw is positioned within the threaded bore. The set screw can directly engage, or cause another member within the threaded bore to engage, a portion of a cutting tool positioned within the recess to secure the cutting tool therein.

In yet a further aspect, the engagement can be such as to minimize any motion between the tool holder an a collar surrounding the cutting tool, so that any wear due to movement of the cutting tool occurs on the cutting tool and the surrounding collar.

DESCRIPTION OF THE DRAWINGS

The above, as well as other advantages of the present invention, will become readily apparent to those skilled in the art from the following detailed description of a preferred embodiment when considered in the light of the accompanying drawings.

DESCRIPTION OF THE EMBODIMENTS

Figure 1:
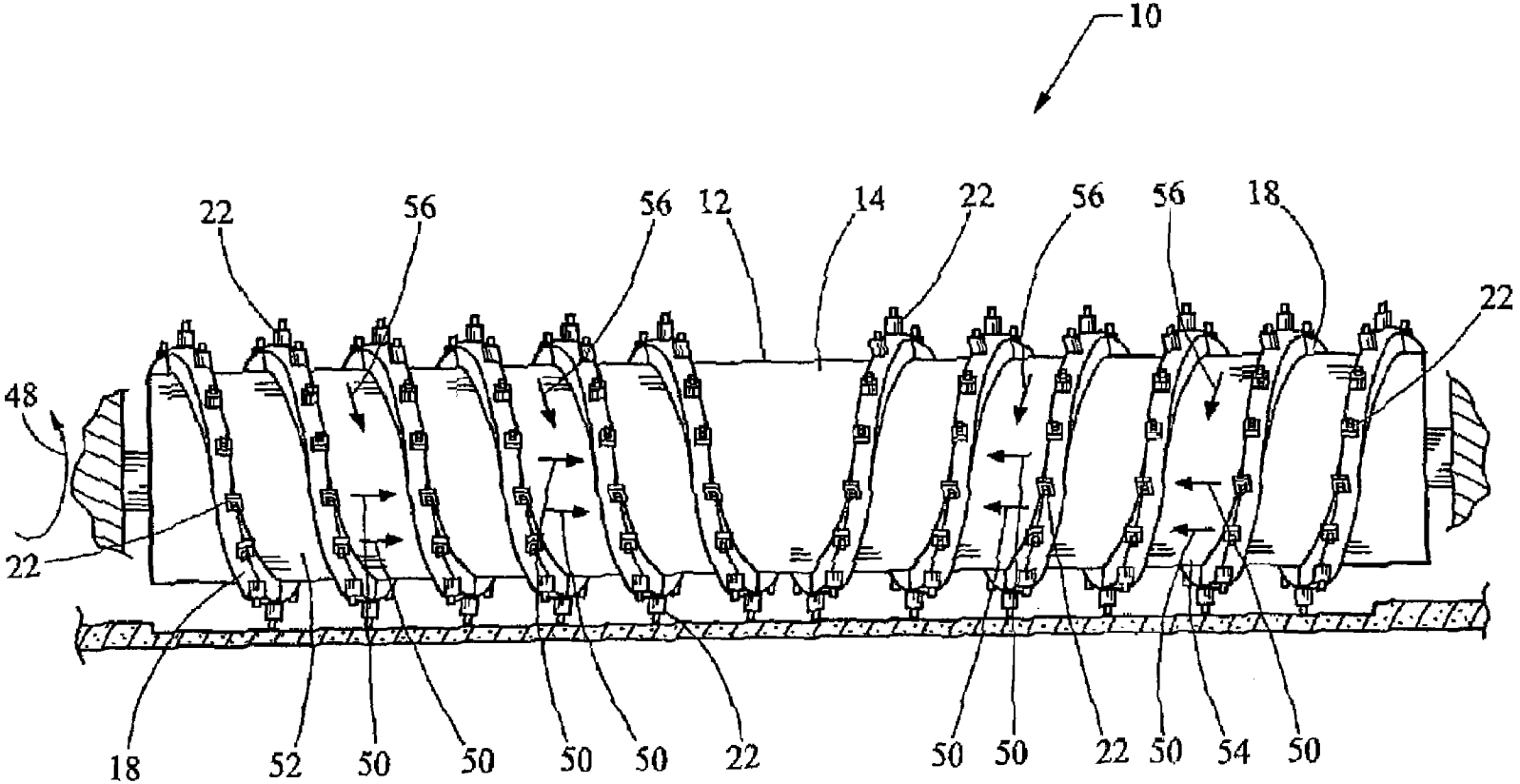
FIG. 1 is a front view of a cutting drum having tool holders in accordance with the present invention.

Referring to FIG. 1, a cutting drum for a scarifying, milling or mining machine having tool holders in accordance with the accompanying claims is shown generally at 10. The cutting drum 10 includes a rotatable drum 12 having a generally cylindrical outer surface 14. A plurality of flight blocks 16 are mounted onto the outer surface 14 of the drum 12. The flight blocks 16 are generally positioned on the drum 12 relative to one another such that the flight blocks 16 define a helical flight 18 extending around the outer surface 14 of the drum 12.

Figure 2:
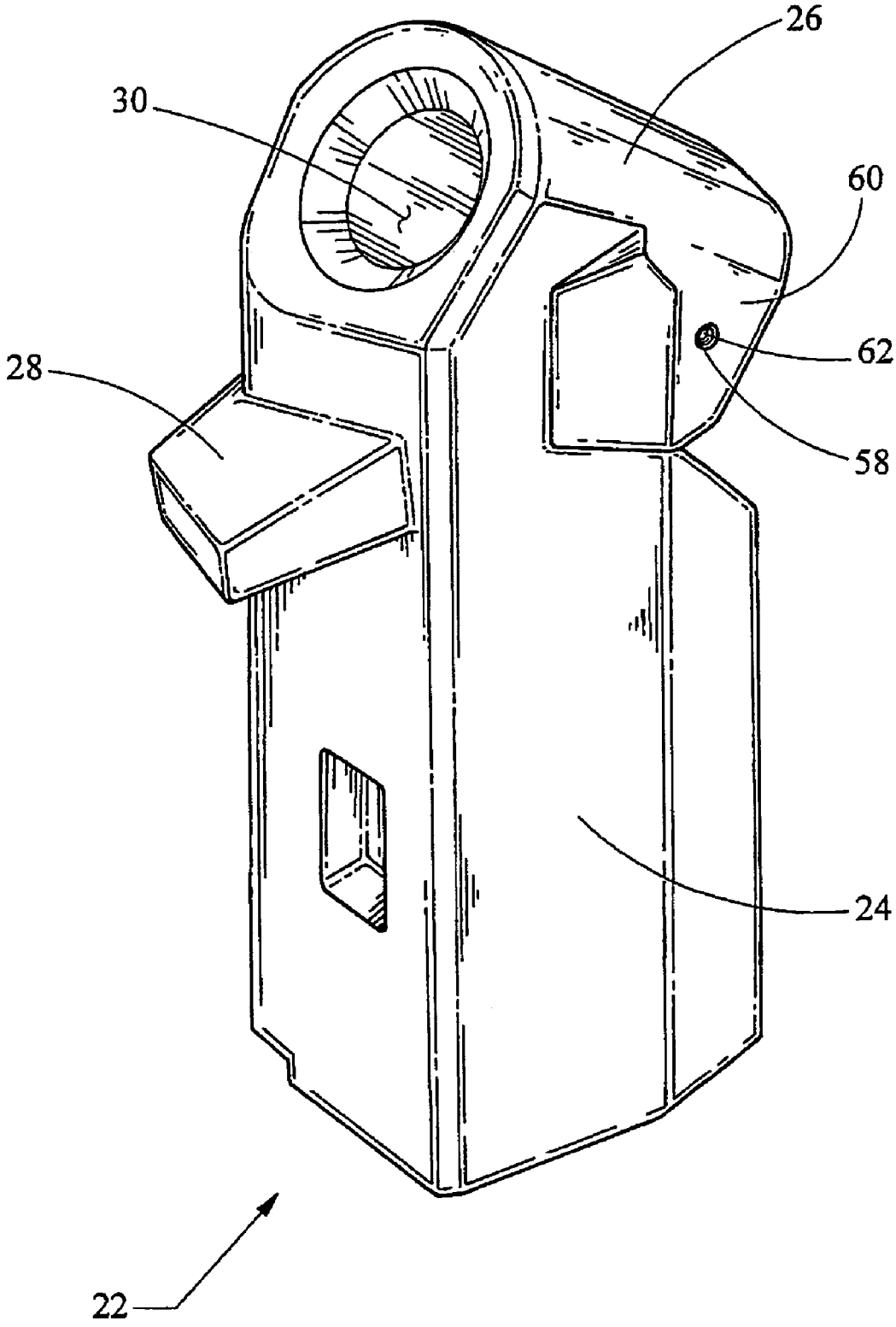
FIG. 2 is a perspective view of a tool holder of the present invention.
Figure 3:
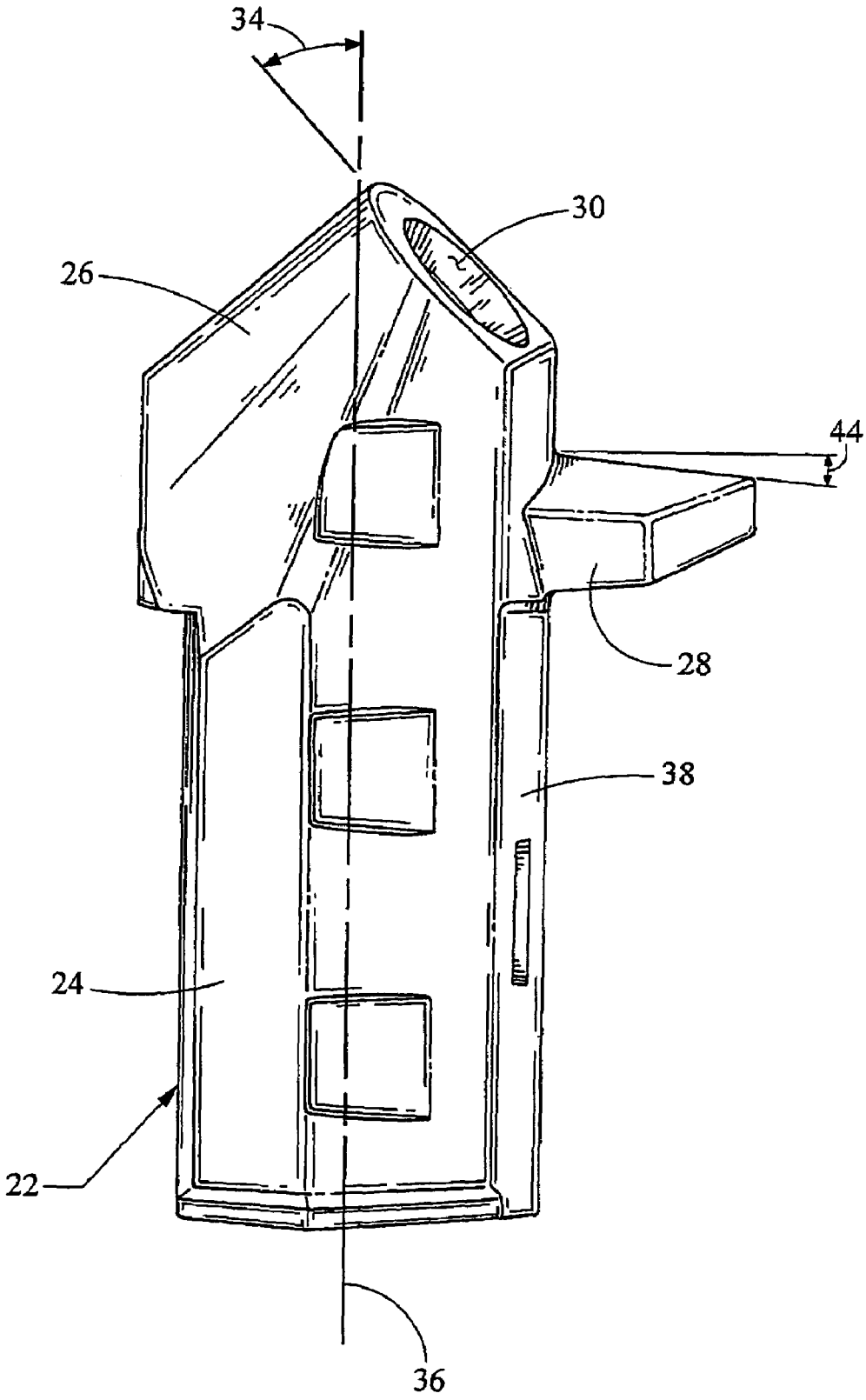
FIG. 3 is a side view of the tool holder, illustrating the angle of the flange away from the head of the tool holder.
Figure 4:
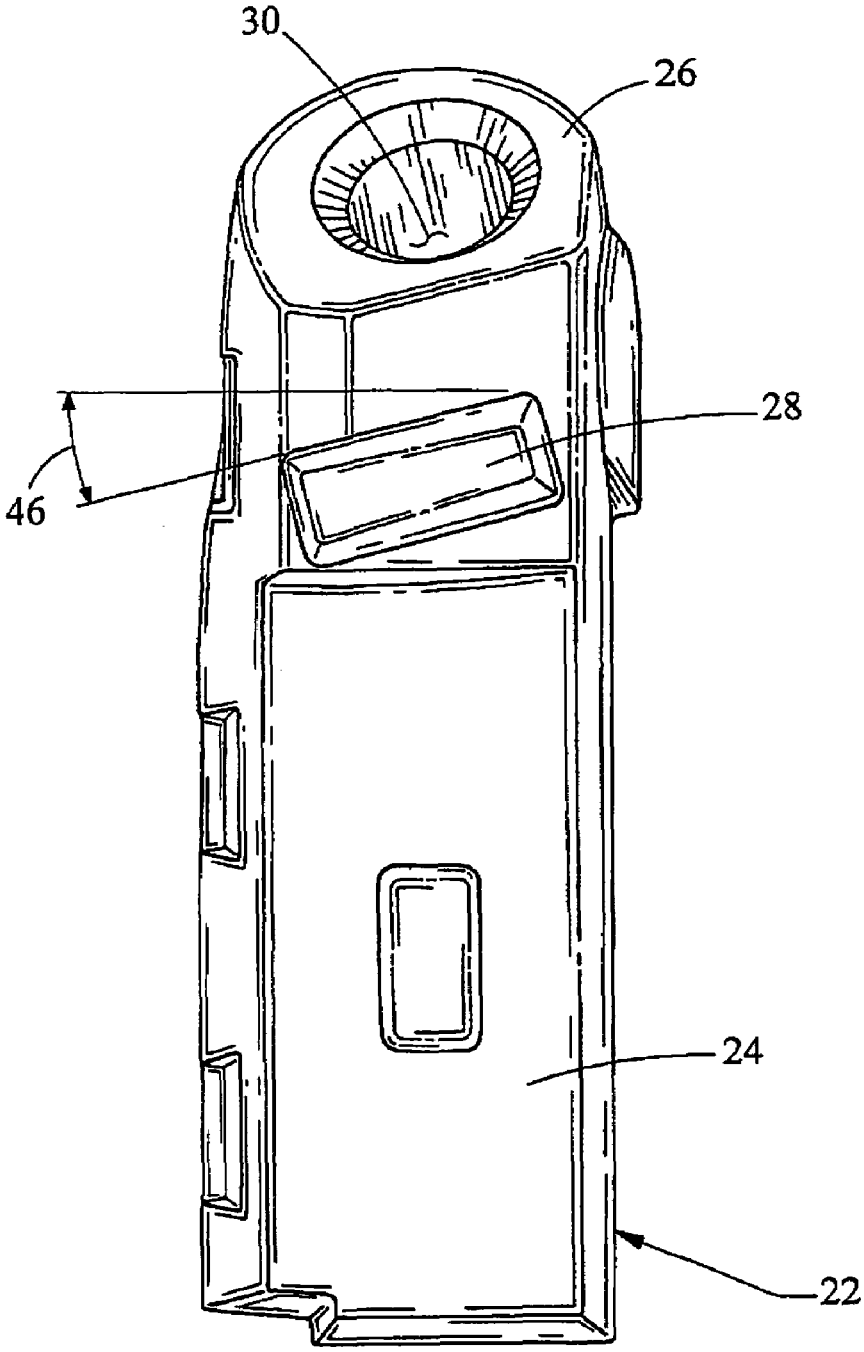
FIG. 4 is front view of the tool holder, illustrating the angle of the flange toward the side of the tool holder.

Each flight block 16 has a slot 20 formed therein that is adapted to receive and support a tool holder 22. Referring to FIGS. 2, 3, and 4, the tool holder 22 can include a body portion 24, a head portion 26, and a flange 28.

The body portion 24 is preferably dimensioned to fit closely within the slot 20 formed within the flight block 16. The body portion 24 can be generally rectangular, but any shape adapted to fit within the slot 20 in a particular flight block 16 is appropriate. The head portion 26 is positioned at a distal end of the body portion 24. A recess 30 is formed within the head portion 26 and is adapted to receive and support a cutting tool 32.

Typically, it is desirable to have the cutting tool 32 presented in a rotationally forward orientation relative to the cutting drum 10. Therefore, the recess 30 formed within the head portion 26 is oriented at an angle 34 relative to a longitudinal axis 36 of the tool holder 22. In this way, the cutting tool 32 is presented in a rotationally forward orientation.

Figure 5:
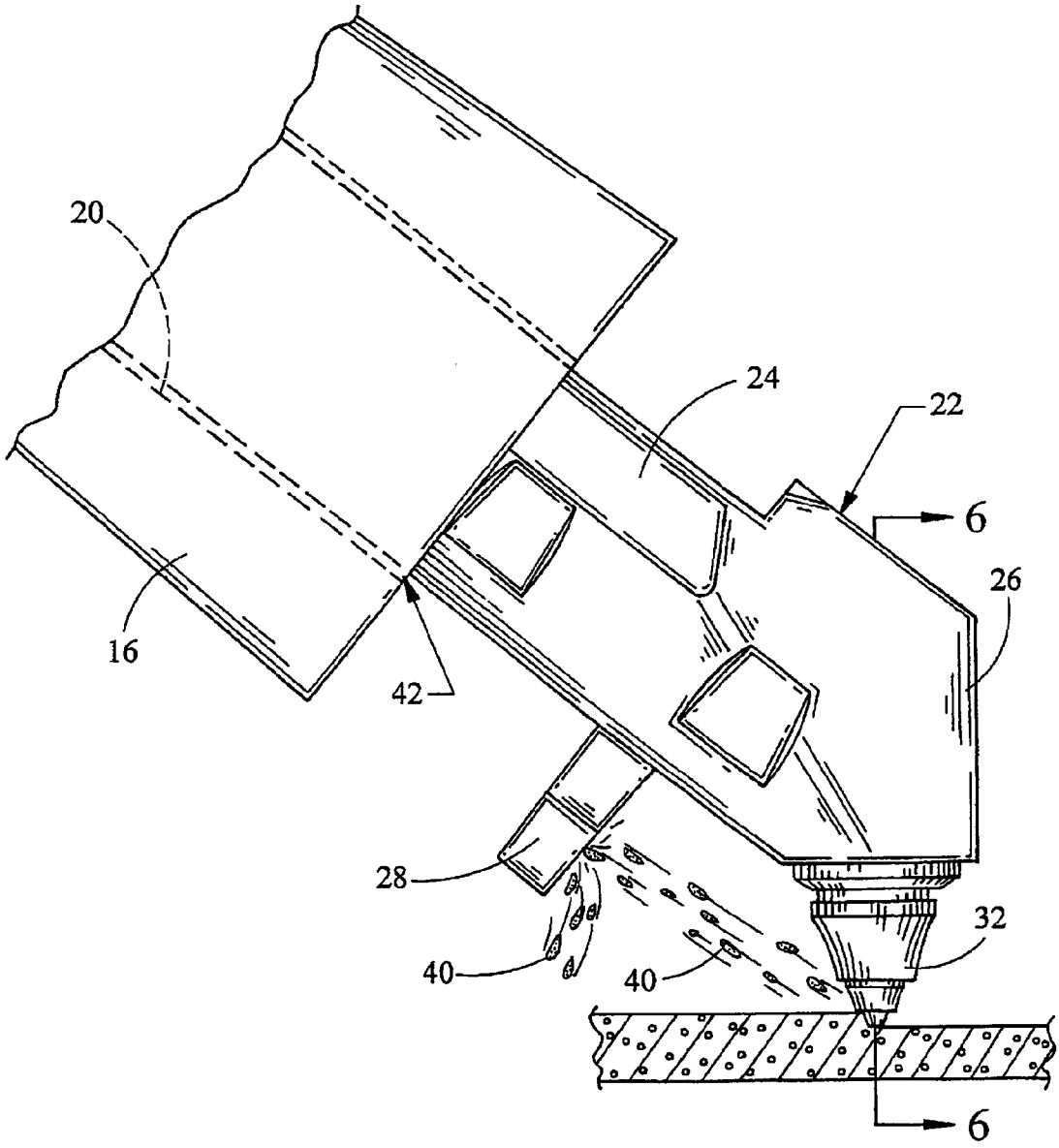
FIG. 5 is a side view of the tool holder having a cutting tool mounted therein and being mounted within a flight block as the cutting tool cuts away the top surface of a roadway.

The flange 28 extends from the body portion 24 adjacent the head portion 26. The flange 28 extends in a rotationally forward direction, from a front side 38 of the tool holder 22. The flange 28 is adapted to deflect debris that is churned up by the cutting tool 32. Referring to FIG. 5, as the cutting tool 32 chips away debris 40, the flange 28 deflects the debris 40 away from the interface 42 between the tool holder 22 and the flight block 16. This reduces the amount of debris that gets between the walls of the slot 20 and the body portion 24 of the tool holder 22, thereby reducing the amount of wear experienced by both the body portion 24 of the tool holder and the slot 20 of the flight block.

Referring to FIG. 3, the flange 28 is oriented at and angle 44 away from the recess 30 to facilitate the flow of debris away from the cutting tool 32. This reduces the chance that debris will build up in front of the flange 28. Also, as shown in FIG. 4, the flange 28 is oriented at an angle 46 toward one side of the tool holder 22. Therefore, the flange 28 deflects the debris 40 to the side of the tool holder 22, again reducing the likelihood that debris 40 will build up in front of the tool holder 22 and reducing the wear to the flight block 16.

Referring again to FIG. 1, the cutting drum 10 rotates as indicated by arrow 48. The side ways angle 46 of the flange 28 causes the debris 40 to be deflected toward the center of the cutting drum 10, as indicated by arrows 50. In use, the tool holders 22 on the left side 52 of the cutting drum 10 would have flanges 28 angled to the right side. Correspondingly, the tool holders 22 on the right side 54 of the cutting drum 10 would have flanges angled to the left side, as shown in FIG. 4. Thus, as the cutting drum 10 rotates, the debris 40 is carried by the helical flight 18 as shown by arrows 56.

Figure 6:
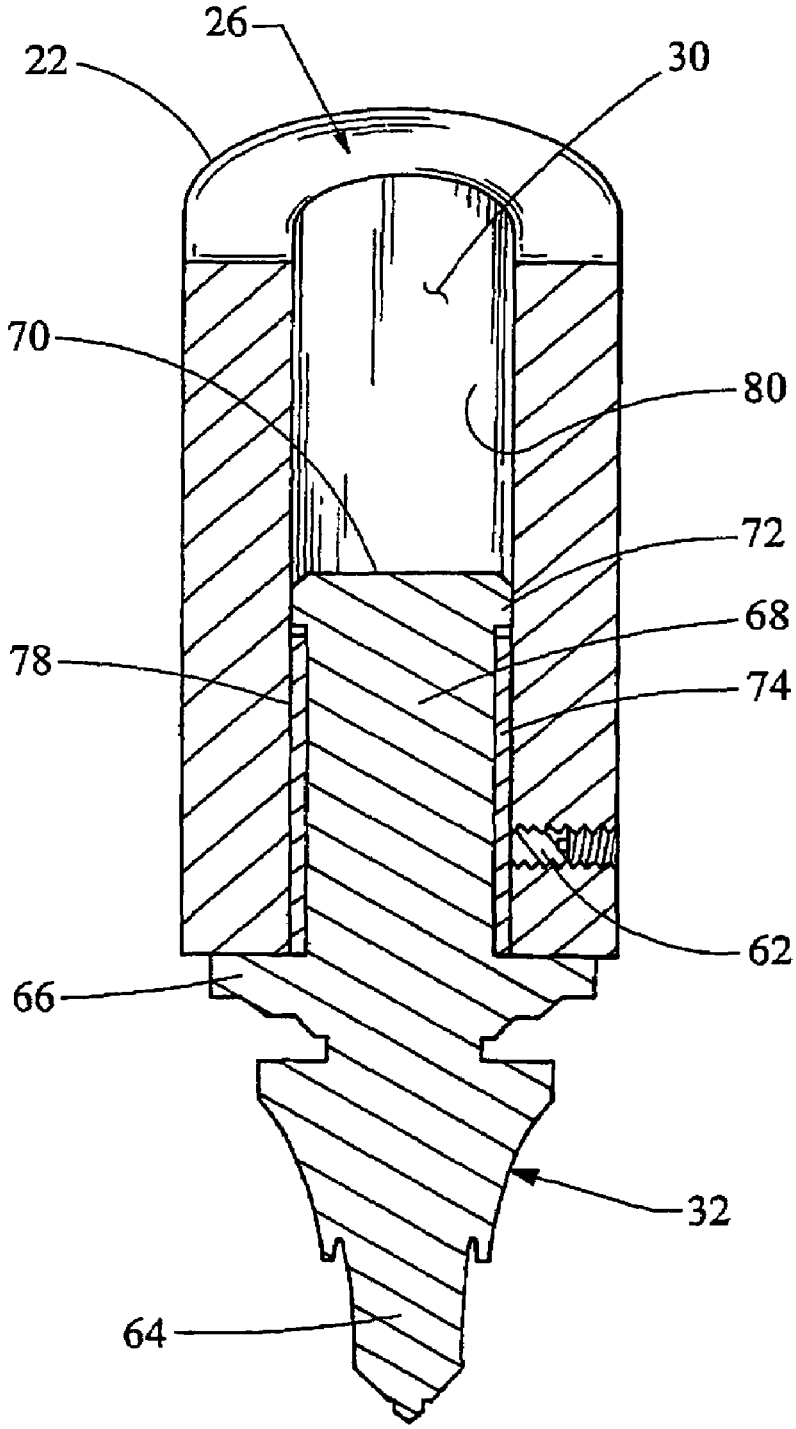
FIG. 6 is a sectional view taken along lines 6-6 of FIG. 5.
Figure 7:
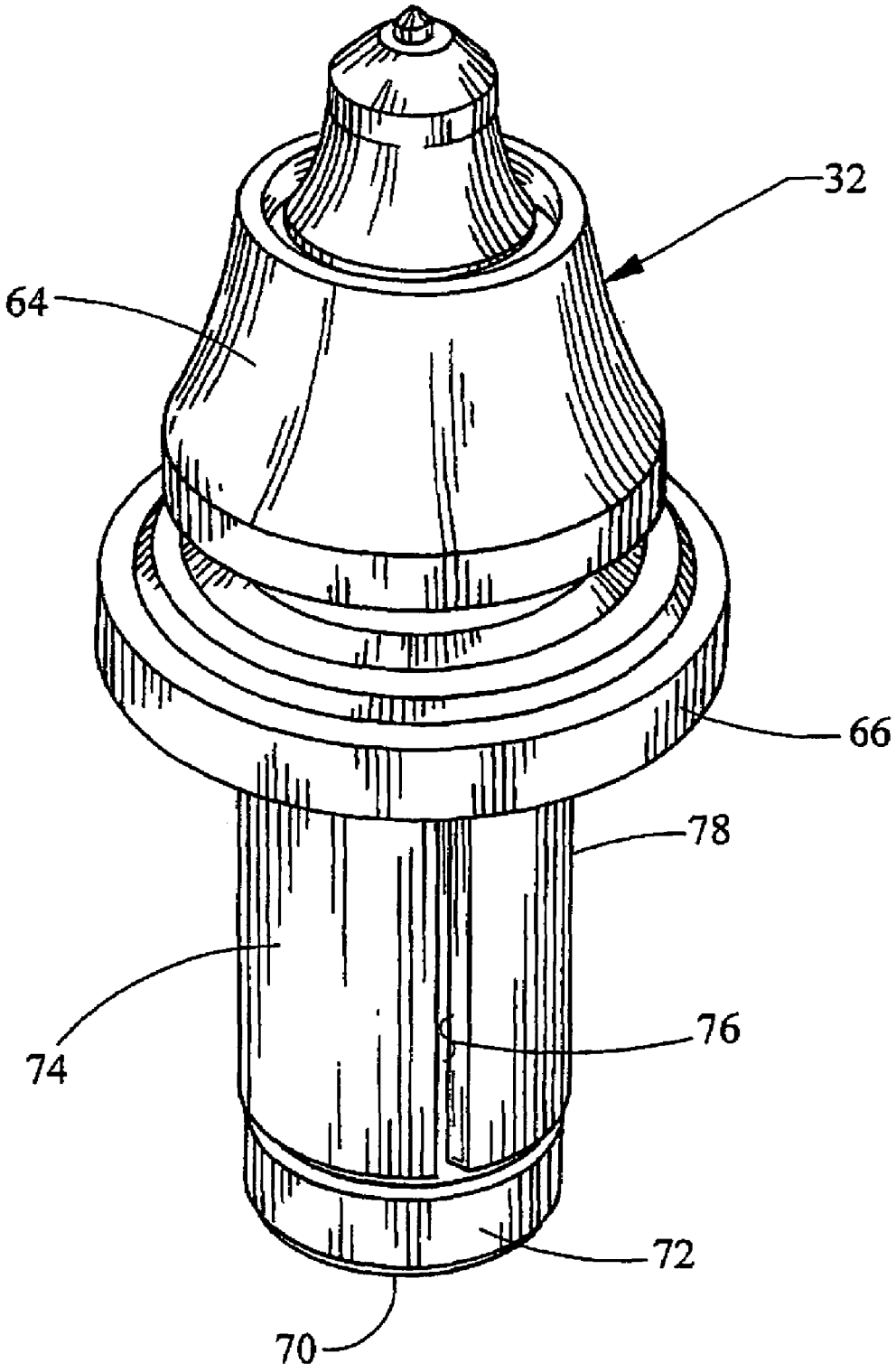
FIG. 7 is a perspective view of the cutting tool having a collar placed thereon.

Referring to FIGS. 6 and 7, a cutting tool 32 that is adapted to fit within the tool holder 22 can include a cutting tip 64 having a flange 66 extending circumferentially therearound. A post 68 extends axially from the cutting tip 64 and includes a distal end 70 having a lip 72 extending radially from the post 68 and extending circumferentially therearound. A collar 74 can be positioned on the post 68 between the lip 72 at the distal end 70 of the post 68 and the flange 66 of the cutting tip 64.

The collar 74 can have a gap 76 formed therein to allow the collar 74 to be expanded or compressed. This gap 76 allows the collar 74 to be expanded when placed onto the post 68, as the collar 74 must fit over the lip 72 formed on the distal end 70. The collar 74 can have a pre-formed shape such that once the collar 74 is placed onto the post 68, an outer diameter 78 of the collar 74 is slightly larger than an inner diameter of the recess 30 within the tool holder 22. In this way, once the cutting tool 32 is placed within the tool holder 22, friction between the outer diameter 78 of the collar 74 and the inner diameter 80 of the recess 30 within the tool holder 22 will keep the cutting tool 32 held within the recess 30, as shown in FIG. 6. Preferably, the collar 74 is made from a material that will allow the collar 74 to be expanded and compressed and return to the pre-formed shape. A material such as spring steel or the like would be appropriate.

Further, the cutting tool 32 is not held immobile within the collar 74. The lip 72 formed at the distal end 70 of the post 68 contacts the collar 74, and the collar 74 is frictionally held within the recess 30, thereby preventing the cutting tool 32 from being axially removed from the recess 30. A force large enough to overcome the frictional contact between the collar 74 and the inner diameter 80 of the recess 30 would be necessary to remove the cutting tool 32 from the recess 30. However, the cutting tool 32 is not completely restricted from rotating within the collar 74. Therefore, as the cutting tip 64 of the cutting tool 32 wears, the cutting tool 32 can, and will rotate such that the cutting tip 64 will wear more evenly. This increases the life of the cutting tool 32.

Referring again to FIGS. 2 and 6, the head portion 26 of the tool holder 22 includes a threaded bore 58 formed therein. The threaded bore 58 extends from the recess 30 to an outer surface 60 of the head portion 26. A threaded set screw 62 can be positioned within the threaded bore 58 and can be adapted to selectively engage the outer diameter 78 of the collar 74. Alternatively, a further contact element can be situated on an inner end of the threaded bore 58 that can be biased or forced into contact with the collar 74 in greater or lesser amount by a spring or other biasing element or by adjusting the position of the set screw 62. Further, the inner end of the set screw 62, or a further contact element, can be forced into engagement with the gap 76 or another surface feature on the collar 74 to further inhibit any movement of the collar 74 in relation to the tool holder 22.

Over time, during use, the cutting tool 32 and the inner surface of the collar 74 will wear, thus causing the collar 74 to collapse inwardly away from the inner surface of recess 30. To maintain engagement of the cutting tool 32 within the recess 30, the threaded set screw 62 can be adjusted inwardly against the outer diameter 78 of the collar 74 to more tightly hold the cutting tool 32 within the recess 30. Alternatively, a spring or other biasing element can cause a contact element to maintain sufficient force on the collar 74 to inhibit any motion between the collar 74 and the recess 30. Further, this structure of the set screw 62 with or without a biasing element such as a spring acting on a further contacting element contacting the collar 74 surrounding the cutting tool post 68 can be employed with a variety of tool holders other than that illustrated in the present Figures.

In accordance with the provisions of the patent statutes, the present invention has been described in what is considered to represent its preferred embodiment. However, it should be noted that the invention can be practiced otherwise than as specifically illustrated and described.

What is claimed is:

1. A tool holder for a scarifying milling machine comprising:

a body portion dimensioned to fit closely within a slot formed within a flight block;

a head portion positioned at a distal end of the body portion and having a recess formed therein to receive a cutting tool and hold the cutting tool in a rotationally forward orientation;

a flange positioned adjacent the head portion and extending from the body portion in a rotationally forward direction, the flange being asymmetrically angled away from the recess and angled to one side of the tool holder to deflect debris away preferentially to said one side of the tool holder.

2. The tool holder of claim 1 wherein, the flange is a generally rectangular body including a top surface with a right edge and a left edge.

3. The tool holder of claim 2 wherein, the right edge of the top surface has a first obtuse angle relative to a front side of the tool holder that is greater than a second obtuse angle of the left edge of the top surface.

4. The tool holder of claim 1 wherein, the head portion includes a threaded bore extending from the recess to an outer surface of the head portion, and a threaded set screw positioned within the threaded bore and adapted to selectively engage a cutting tool positioned within the recess to secure the cutting tool therein.

5. The tool holder of claim 1 wherein, the recess formed within the head portion is oriented at an angle relative to a longitudinal axis of the tool holder, such that the cutting tool is presented in a rotationally forward orientation.

6. A tool holder for a scarifying milling machine comprising:

a body portion dimensioned to fit closely within a slot formed within a flight block;

a head portion positioned at a distal end of the body portion and having a recess formed therein to receive a cutting tool and hold the cutting tool in a rotationally forward orientation, the head portion including a threaded bore extending from the recess to an outer surface of the head portion, a threaded set screw being positioned within the threaded bore and adapted to selectively engage a cutting tool positioned within the recess to secure the cutting tool therein, and a flange being a generally rectangular body positioned adjacent the head portion on a front side of the tool holder and extending from the body portion in a rotationally forward direction, the flange having a similar width to that of the front side of the tool holder, the flange being asymmetrically angled away from the cutting tool recess and angled to one side of the tool holder to facilitate deflection of debris away preferentially to said one side of the tool holder.

7. A tool holder and cutting tool for a scarifying milling machine comprising:

said tool holder having a body portion dimensioned to fit closely within a slot formed within a flight block; a head portion positioned at a distal end of the body portion and having a recess formed therein to receive said cutting tool and hold the cutting tool in a rotationally forward orientation; and a flange positioned adjacent the head portion and extending from the body portion in a rotationally forward direction, the flange of the tool holder being asymmetrically angled away from the recess and angled to one side of the tool holder to deflect debris away preferentially to said one side of the tool holder; and the cutting tool having a cutting tip with a flange extending circumferentially therearound and a post extending axially from the cutting tip, the post including a distal end having a lip extending radially therefrom and extending circumferentially therearound, a collar being positioned around the post between the lip and the flange of the cutting tool, wherein the cutting tool is held within the tool holder by frictional contact between the collar and an inner diameter for the recess.

8. The tool holder and cutting tool of claim 7 wherein, the flange of the tool holder is a generally rectangular body including a top surface with a right edge and a left edge.

9. The tool holder and cutting tool of claim 8 wherein, the right edge of the top surface has a first obtuse angle relative to a front side of the tool holder that is greater than a second obtuse angle of the left edge of the top surface.

10. The tool holder and cutting tool of claim 7 wherein, the head portion includes a threaded bore extending from the recess to an outer surface of the head portion, and a threaded set screw positioned within the threaded bore and adapted to selectively engage the collar of the cutting tool positioned within the recess to secure the cutting tool therein.

11. The tool holder and cutting tool of claim 7 wherein, the recess formed within the head portion of the tool holder is oriented at an angle relative to a longitudinal axis of the tool holder, such that the cutting tool is presented in a rotationally forward orientation.

12. The tool holder and cutting tool of claim 7 wherein, the cutting tool is rotationally moveable within the collar such that as the cutting tip of the cutting tool wears, the cutting tool rotates within the tool holder.

13. A tool holder and cutting tool for a scarifying, milling or mining machine comprising:

said tool holder having a body portion dimensioned to be secured to a rotatable drum, a head portion positioned at a distal end of the body portion and having a recess formed therein to receive said cutting tool and hold the cutting tool in a rotationally forward orientation relative to the drum; a flange positioned adjacent the head portion and extending from the body portion in a rotationally forward direction, the flange of the tool holder being asymmetrically angled away from the recess and angled to one side of the tool holder to deflect debris away preferentially to said one side of the tool holder; and a threaded opening extending between the recess and an outer surface of the tool holder;

the cutting tool having a cutting tip with a flange extending circumferentially therearound and a post extending axially from the cutting tip, the post including a distal end, a collar being positioned around the post distally from the flange of the cutting tool, the collar outer dimension being selected to hold the cutting tool within the tool holder by frictional contact between the collar and an inner diameter for the recess; and a screw and collar contact element received in the threaded opening, the screw being adjustable relative to the threaded opening to force the contact element into engagement with the collar to inhibit rotation of the collar relative to the tool holder recess.

14. The tool holder and cutting tool of claim 13 wherein, the flange of the tool holder is a generally rectangular body including a top surface with a right edge and a left edge.

15. The tool holder and cutting tool of claim 14 wherein, the right edge of the top surface has a first obtuse angle relative to a front side of the tool holder that is greater than a second obtuse angle of the left edge of the top surface.

16. The tool holder and cutting tool of claim 13 wherein, the distal end of the cutting tool post includes a lip extending radially therefrom and extending circumferentially therearound, the lip contacting a distal edge of the collar surrounding the cutting tool post.

17. The tool holder and cutting tool of claim 13 wherein, the collar contact element includes a biasing element for maintaining a force on the collar even in the event the collar collapses radially inward within the recess.

18. The tool holder and cutting tool of claim 17 wherein, the biasing element is a spring located between the collar contact element and said screw.

* * * * *